US007118012B2

(12) United States Patent
Butler

(10) Patent No.: US 7,118,012 B2
(45) Date of Patent: Oct. 10, 2006

(54) DISPENSING CONTAINER

(75) Inventor: David George Butler, Bolton (GB)

(73) Assignee: Bettix Limited, Bolton (GB)

( * ) Notice: Subject to any disclaimer, the term of this patent is extended or adjusted under 35 U.S.C. 154(b) by 0 days.

(21) Appl. No.: 10/484,875

(22) PCT Filed: Jul. 26, 2002

(86) PCT No.: PCT/GB02/03427

§ 371 (c)(1),
(2), (4) Date: Jan. 26, 2004

(87) PCT Pub. No.: WO03/011474

PCT Pub. Date: Feb. 13, 2003

(65) Prior Publication Data

US 2004/0251282 A1 Dec. 16, 2004

(30) Foreign Application Priority Data

Jul. 26, 2001 (GB) ..... 0118197.3

(51) Int. Cl.
*B67D 5/42* (2006.01)

(52) U.S. Cl. ..... 222/129; 222/145.5; 222/382; 222/383.1

(58) Field of Classification Search ..... 222/372, 222/383.1, 382, 129, 206, 207, 211, 212, 222/145.1
See application file for complete search history.

(56) References Cited

U.S. PATENT DOCUMENTS 2,280,657 A * 4/1942 McCandliss ..... 48/176
4,154,369 A 5/1979 Morane
5,325,996 A * 7/1994 Bannigan ..... 222/133
5,890,624 A 4/1999 Klima et al.
6,041,969 A 3/2000 Parise
6,152,326 A * 11/2000 Klima, Jr. et al. ..... 222/82

(Continued)

FOREIGN PATENT DOCUMENTS

DE 8912923 1/1990

(Continued)

*Primary Examiner*—Joseph A. Kaufman
(74) *Attorney, Agent, or Firm*—Woodard, Emhardt, Moriarty, McNett & Henry LLP

(57) ABSTRACT

A dispensing container (1) for a liquid comprises: (i) a bottle (2) having a main chamber (5) for holding a first liquid (21) to be dispensed from the container and a secondary chamber (8) for holding a concentrate (22) of the first liquid, and (ii) a closure element (3) removably located on the mouth of the bottle. The secondary chamber (8) is associated with an outlet aperture through which the concentrate (22) may be transferred from the secondary chamber (8) into the main chamber (5). The container (1) is further provided with a plugging assembly (16) which plugs the outlet aperture when the closure element (3) is located on the mouth of the bottle and allows liquid (22) to be transferred from the secondary chamber (8) into the main chamber (5) when the closure element (3) is removed. Once all of the liquid (25) in the main chamber (5) has been dispensed, a further aliquot of concentrate (22) may be transferred from secondary chamber (8) to the main chamber (5) and diluted therein so that the container is again ready for use. In this way, the main chamber (5) and diluted therein so that the container is again ready for use. In this way, the main chamber (5) may be re-filled several times using the concentrate (22) stored in chamber (8).

18 Claims, 2 Drawing Sheets

U.S. PATENT DOCUMENTS

| | | | | |
|---|---|---|---|---|
| 6,182,865 | B1 | 2/2001 | Bunschoten et al. | |
| 6,250,511 | B1 * | 6/2001 | Kelly | 222/382 |
| 6,290,100 | B1 * | 9/2001 | Yacko et al. | 222/129 |
| 6,360,918 | B1 | 3/2002 | Butler | |
| 6,659,831 | B1 * | 12/2003 | Thai | 446/15 |

FOREIGN PATENT DOCUMENTS

| | | |
|---|---|---|
| EP | 0795267 | 9/1997 |
| GB | 2259695 | 3/1993 |
| GB | 2280657 | 2/1995 |

* cited by examiner

DISPENSING CONTAINER

The present invention relates to a dispensing container.

Numerous forms of dispensing containers are used in the domestic environment, e.g. in the kitchen and garden. One type of such container which is particularly popular is the so-called "trigger-spray container" which comprises a bottle (holding a liquid to be dispensed) and a trigger-spray mounted on the mouth of the bottle and having a dip tube extending into a lower region thereof. On actuating the trigger, the contents of the bottle are discharged as a spray through the nozzle of the trigger-spray unit.

It is generally the case that, once the bottle is empty, the whole dispensing container (which is usually of plastics material) is simply discarded and this is obviously disadvantageous from the environmental point of view. It is of course possible to provide for re-use of the dispensing container by filling the bottle with liquid to be dispensed. This may be done in one of two ways. In one way, the householder has another container of the liquid to be dispensed (by the trigger-spray unit) and simply fills the bottle with that liquid. In another way, the householder has a concentrated version of the liquid to be dispensed and introduces the concentrate into the bottle for dilution to the required strength. In either case there is a disadvantage that the replacement liquid (concentrate) needs to be held in a separate container and transferred to the bottle to be replenished. This can be messy and spills may result unless extreme care and time is taken. Additionally concentrated chemicals can harm flooring and general surfaces if spillage occurs.

GB-A-2 369 609 (Bettix Ltd) discloses a "multi-use" dispensing container which comprises a main chamber for holding the liquid to be dispensed (e.g. via a trigger-spray unit) and a flexible walled secondary chamber for holding a concentrate of that liquid. When the liquid in the main chamber is exhausted, concentrate may be expressed into the main chamber from the secondary chamber via a duct which extends from a lower region of the secondary chamber upwardly along one side thereof to an outlet above the secondary chamber. Water may be added to the main chamber to dilute the concentrate to the required strength for use. Such dispensing containers satisfy their "multi-use" function in a perfectly satisfactory manner but do have one potential draw back related to the fact that the aforementioned duct provides, in effect, a permanent communication between the main and secondary chambers. If the dispensing container is knocked over there is a possibility of liquid being transferred from the main chamber into the secondary chamber (thus diluting the concentrate) or of concentrate being transferred from the secondary chamber into the main chamber thus making the liquid therein stronger that actually required.

It is therefore an object of the present invention to obviate or mitigate the above mentioned disadvantage.

According to the present invention there is provided a dispensing container for a liquid comprising (i) a bottle having a main chamber for holding a first liquid to be dispensed from the container and a secondary chamber for holding a concentrate of the first liquid, and (ii) a closure element removably located on the mouth of the bottle, wherein the secondary chamber is associated with an outlet aperture through which the concentrate may be transferred from the secondary chamber into the main chamber and wherein the container is provided with a plugging assembly which plugs said outlet aperture when the closure element is located on the mouth of the bottle and allows liquid to be transferred from the secondary chamber into the main chamber when the closure element is removed.

Thus in the dispensing container of the invention the outlet associated with the secondary chamber is closed by means of a plugging assembly which, with the closure element in position, prevents liquid inadvertently passing from one chamber to the other, e.g. in the event that the dispensing container is knocked over. However the plugging assembly is such that when the closure element is removed concentrate may be transferred from the secondary chamber to the main chamber.

Conveniently the outlet aperture associated with the secondary chamber is provided directly below, and most preferably in axial alignment with, the mouth of the bottle thus allowing for linear movement of the plugging assembly for its operation. It is particularly preferred that the secondary chamber has a filling aperture (through which the secondary chamber is filled prior to final assembly of the dispensing container) located directly below the mouth of the bottle and that (in the assemble container) this filling aperture is closed by a bung having a bore which provides the outlet aperture of the secondary chamber. Preferably a tube extends from the lower end of the bore to the base of the secondary chamber. To ensure complete emptying of the secondary chamber the base may slope towards a well formation (in the base) and the lower end of the tube locates in this well formation.

Preferably the dispensing container is such that locating the closure member on the bottle causes the plugging assembly to be moved linearly to push a plug associated therewith onto or into the outlet aperture of the secondary chamber to effect liquid tight closure thereof. This may be ensured by providing the plugging assembly such that, when positioned in the bottle and prior to fitting of the closure member, a portion of the plugging assembly projects out of the mouth of the bottle without the plug being in engagement with the outlet aperture of the secondary chamber. On fitting the closure member the plugging assembly is moved inwardly of the bottle so as to bring its plug into engagement with the aperture. On removal of the closure member there will be sufficient play in the position of the plugging assembly to permit movement thereof to allow transfer of concentrate from the secondary chamber via the outlet aperture into the main chamber. However in an advantageous embodiment of the invention, the plugging assembly may be provided with spring means which urge said assembly away from the aperture when the closure member is removed thus disengaging the plug from the aperture. The spring means may, for example, comprise resilient legs provided on the plugging assembly.

Preferably the secondary chamber has flexible walls such that, with the closure element removed, squeezing of these walls causes liquid to be expressed from the secondary chamber, this expression of liquid being sufficient to allow for movement of the plugging assembly away from the aperture to permit liquid transfer.

In a particularly preferred embodiment of the invention the mouth of the bottle is of lesser diameter than the neck thereof and the plugging assembly comprises an upper head (preferably tubular) capable of being located in the mouth of the bottle, a lower plug for closing the outlet aperture of the secondary chamber and an intermediate portion which is of greater cross-sectional size than the mouth but which is resiliently deformable to reduce its cross-sectional size to permit insertion through the mouth of the bottle. In this embodiment the plugging assembly is located in position in the bottle plug member first and said intermediate portion is deformed so as to permit its insertion through the bottle mouth. In the bottle neck the intermediate portion is able to expand so as to be retained in the bottle.

The intermediate portion may for example be a resilient split ring which lies in a plane transverse to the longitudinal axis of the plugging assembly (along which the assembly is inserted into the bottle) and which may be "pinched" to effect a reduction in diameter for insertion through the bottle mouth as described. It is however more preferred that the plugging assembly has a body which has a greatest cross-sectional size at a position intermediate the head and the plug and which progressively increases in cross-sectional size going in the direction from either the head or the plug to said position. Such a body portion may comprise a plurality of general by V-shaped webs and may be deformed by insertion into the bottle mouth.

The dispensing container of the invention may be intended for household "maintenance" operations and as such the liquid to be dispensed may for example be for anti-bacterial use or for cleaning use, e.g. for window cleaning, floor clearing, general surface cleaning or de-greasing. Alternatively the dispensing container of the invention may be for a drink which is to be poured or consumed from the container.

Preferably the closure member is associated with a dispensing outlet. In the case where the container I-includes a product for household "maintenance" then conveniently the closure member is part of a trigger-spray assembly whereof the nozzle provides the dispensing outlet and the dip tube locates through an opening in the plugging assembly and extends to the base of the main chamber. In the case where the dispensing container holds a drink then the closure member may be associated with a "pop-up" valve through which drink from the main chamber is consumed (the plugging assembly being appropriately configured to allow passage of the drink from the main chamber to the valve). Such a valve may comprise a central pillar and an outer cylindrical shroud having an upper drinking aperture. With the shroud located in its lower position, the outlet is closed by the top of the pillar. Once the shroud is "popped-up" drink from the main chamber is able to pass between the pillar and the shroud and out through the drinking aperture.

The invention will be further described by way of example only with reference to the accompanying drawings, in which.

Figure 3:
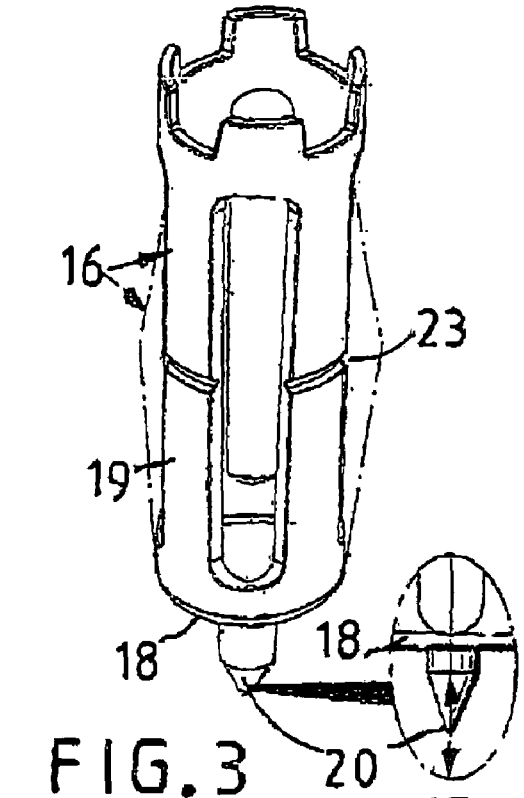
FIG. 3 is a detail of a plugging assembly.

The illustrated dispensing container 1 comprises a plastics bottle 2 provided with a conventional trigger-spray dispensing unit 3 removably mounted on the screw-threaded mouth 4 (see FIG. 2) of the bottle 2. Internally, bottle 2 is subdivided into a main chamber 5 communicating with the neck 6 of the bottle via a throat region 7, and a secondary chamber 8 provided generally above the main chamber 5 but below the neck 6 and to one side of the throat region 7.

The upper wall 9 of the secondary chamber 8 is formed, directly below the mouth 4, with an aperture 10 whereas the base 11 of this chamber is formed with a small depression or well 12 below the centre of aperture 10. The base 11 of secondary chamber 8 slopes generally towards the well 12.

Located within the aperture 10 is bung 13 which is formed with an axial bore 14 and from which depends a tube 15 whereof the lower end reaches into the well 12. For the purposes of providing a good liquid-tight seal between itself and the wall of the aperture 10, bung 13 is formed from an appropriate blend of polymers.

Located within the neck 6 of the bottle 2 is a plastics plugging assembly 16 which, in the manner described more fully below, serves to close the bore 14 of bung 13 when the head of the trigger-spray unit 3 is mounted on the bottle (see FIG. 1) but allows for opening of the bore 14 when that unit is removed (see FIG. 2). More particularly, the plug assembly 16 comprises an upper, castellated head 17 and a lower disk 18 (both of lesser diameter than the internal diameter of the mouth 4) connected by four circumferentially spaced resilient webs 19 which together define a cage structure. A plug member 20 is provided on the underside of disk 18.

The webs 19 are formed so that, in axial section, they are of shallow V-shaped configuration with the apex of the V being directed away from the longitudinal axis of the plugging assembly 16. Thus the central region of the cage structure defined by the webs 19 is of greater diameter than the ends of that structure. Moreover the central diameter of the cage structure is slightly greater than the internal diameter of the neck 6 of the bottle 2 which in turn is of greater diameter than the neck 4. Nevertheless there is sufficient resilience in the webs 19 such that the central region may adopt a diameter corresponding with that of the mouth 4 of the bottle.

Reference is now made to FIG. 3 to illustrate the manner in which the plugging assembly 16 is produced so as to have the configuration described more fully above. The plugging assembly is injection moulded using a tool which produces the generally cylindrical structure illustrated in FIG. 3. This structure includes outer peripheral grooves 21 midway along the outer surfaces of each of the webs 19. Whilst the moulded article is still warm (and therefore capable of being deformed into a configuration which is retained on cooling) the article is removed from the mould by advancing one end in one direction whilst restraining movement of the other end so that an axial compression force is generated. As a result the webs 19 become angled outwardly by virtue of presence of the grooves 23 to adopt their shallow V-shaped configuration described more fully above.

Figure 1:
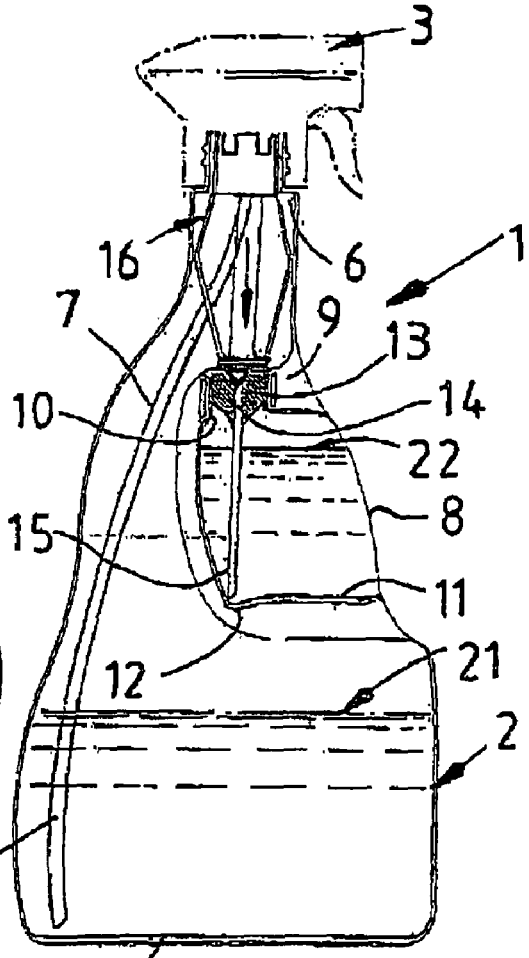
FIG. 1 is a cross-sectional view of one embodiment of the trigger-spray dispensing container in accordance with the invention.
Figure 2:
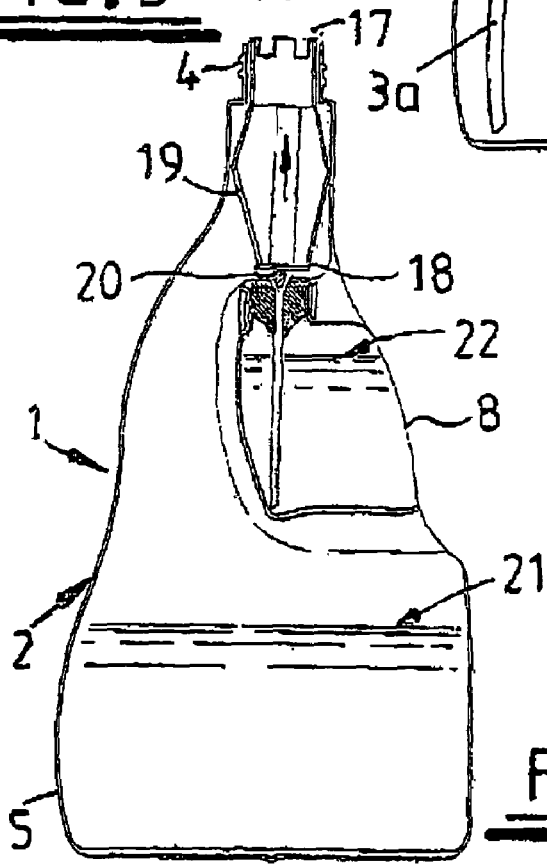
FIG. 2 is similar to FIG. 1 but with the trigger-spray removed.

Reference is now made back to FIGS. 1 and 2 to describe the manner in which the dispensing container 1 is filled and assembled for use.

Initially bottle 2 is produced as a blow-moulded plastics article and does not incorporate the bung 13, tube 15 or plugging assembly 16. Thus in its "as-moulded" configuration of the bottle, the secondary chamber 8 may be filled via the filling aperture 10 with a concentrate 22 by means of a filling tube (not shown) which is inserted into the neck 6 of the bottle and withdrawn after filling. Subsequently bung 13 with its attached tube 15 is inserted through the mouth 4 and neck 6 of the bottle and pressed firmly home so that the bung seats securely in the aperture 10.

Plugging assembly 16 is now inserted into the mouth 4 of the bottle and pushed into the neck 6. This is possible by virtue of the resilience of the webs 19 allowing them to flex inwardly so that the central region of the cage structure they define can pass through the mouth 4. Once it has been fully inserted, the plugging assembly 16 is positioned as shown in FIG. 2 from which a number of points may be noted. Firstly, the webs 19 have flexed back outwardly so as to engage with a light spring pressure against the inner surface of the neck 6. Secondly, the upper end of the castellated head 17 of the plugging assembly projects slightly out of the top of the neck 4 of the bottle. Thirdly, the plug member 20 locates just above the upper end of the bore 14 in bung 13.

A diluted form 21 of the concentrate 22 may now be introduced through the top of the plugging assembly for passage downwardly into the main chamber 2. Passage of this dilute form 21 into the secondary chamber 8 is prevented by virtue of the location of the disk 18 and the plug member 20.

Finally the trigger spray unit 3 is located in position, initially by locating the dip tube 3*a* between two of the webs 19 (so that the dip tube 3*a* extends to the bottom of the main chamber 5) and finally by screwing the head of the unit onto the mouth 4. This latter action ensures that the plugging assembly 16 is urged downwardly so as to urge the plug member 20 into the bore 13 (of bung 14).

The container 1 may now be used in conventional manner to dispense liquid 21 from the chamber 5 (by operation of the trigger-spray unit 3).

Once the liquid 21 in main chamber 5 has been depleted, trigger-spray unit 3 may be removed. The sides of the secondary chamber 8 may now be squeezed towards each other to cause concentrate 22 to pass upwardly along tube 15 and into the bore 14 of bung 13. The pressure which the concentrate is expressed from the secondary chamber 8 is sufficient to cause the plug member 20 to be dislodged to allow the concentrate to issue from the bore for passage into the main chamber 5. Subsequently water is introduced through the castellated head 17 of the plugging assembly 16 to dilute the concentrate in the main chamber 5 and produce a further supply of liquid 21. The trigger-spray unit 3 is then replaced (as described above) so that the dispensing container is again ready for use.

It would be appreciated that numerous refills of main chamber 5 may be made from the concentrate 22 in the secondary chamber 8 although the actual number of refills will depend on the relative volumes of the chambers 5 and 8 and the dilution required for the concentrate 22. It is possible, for example, for the bottle to provide for only one refill in which case the entire contents of secondary chamber 8 are discharged into the main chamber 5 for dilution. Generally however the container will be such that 2 or (preferably) more refills of main chamber 5 are possible with the volume of concentrate 22 provide in secondary chamber 8.

A number of changes may be made for the embodiment of the invention that has been described and illustrated.

Thus, for example, the side walls of secondary chamber 8 may be provided with graduation marks to assist in determining how much concentrate 22 is to be transferred to the main chamber 5 for the purposes of one refill thereof. Similarly main chamber 5 may also have graduation marks to indicate the level of dilution required for the concentrate.

In an alternative arrangement, the main chamber 5 of the dispensing container 1 as supplied to the end-user may be empty (rather than being pre-filled in the factory) thus providing substantially reduced transportation weight.

Furthermore although the dispensing container has been illustrated as incorporating a trigger-spray unit this is not essential. It is possible, for example, to use other forms of dispensing arrangement. Thus in an embodiment of the invention where the liquid 21 in the main chamber 5 is a drink (and the liquid 22 in secondary chamber 8 is a drink concentrate) the dispensing arrangement may comprise a valve of the "pop-up" type e.g. as illustrated in U.S. Pat. No. 5,651,471 and as frequently found on so-called "sports bottles" containing a drink.

It is also possible for the bottle simply to have a closure element (e.g. a screw-cap or other seal). This will particularly be the case where the liquid 21 is for use in a watering can. A still further possibility is for the dispensing container 1 to be supplied in a package which incorporates both a screw-cap (or other seal) and a trigger-spray head for multi-use purposes.

Figure 4:
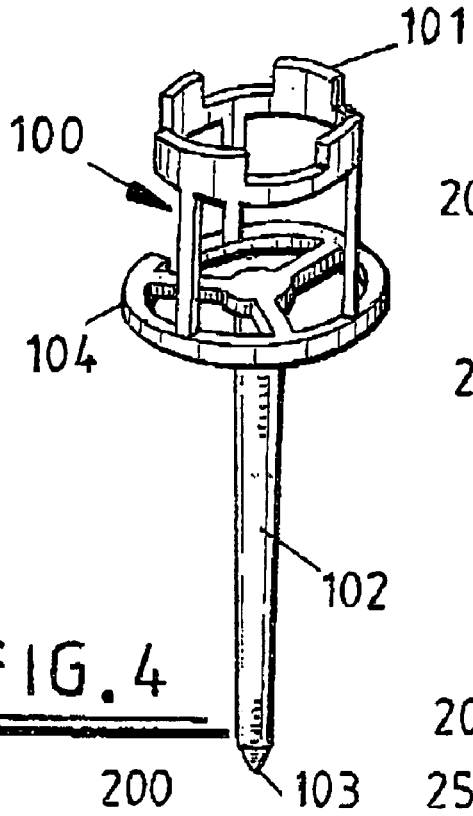
FIG. 4 illustrates an alternative embodiment of plugging assembly.

Reference is now made to FIG. 4 which illustrates an alternative plugging assembly 100. This assembly comprises an upper castellated head 101, a stem 102 at the bottom of which is a plug 103 and an intermediate split ring 104. The plugging assembly of FIG. 4 may be inserted into a bottle 2 of the type illustrated in FIG. 1 by "pinching" the split ring to permit its insertion through the bottle mouth 4 and subsequent expansion in the neck 6 of the bottle. Otherwise the plugging assembly is a manner analysis to that of the above described plugging assembly 16.

Figure 5:
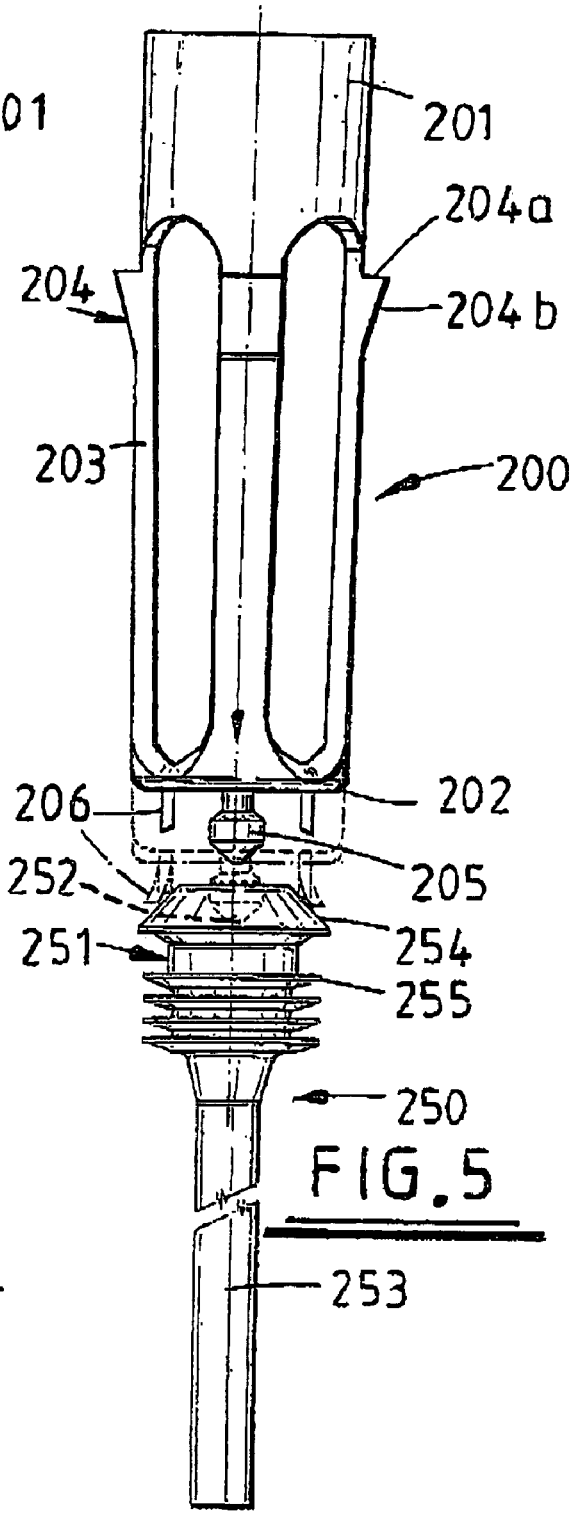
FIG. 5 illustrates a plugging assembly and bung unit.
Figure 6:
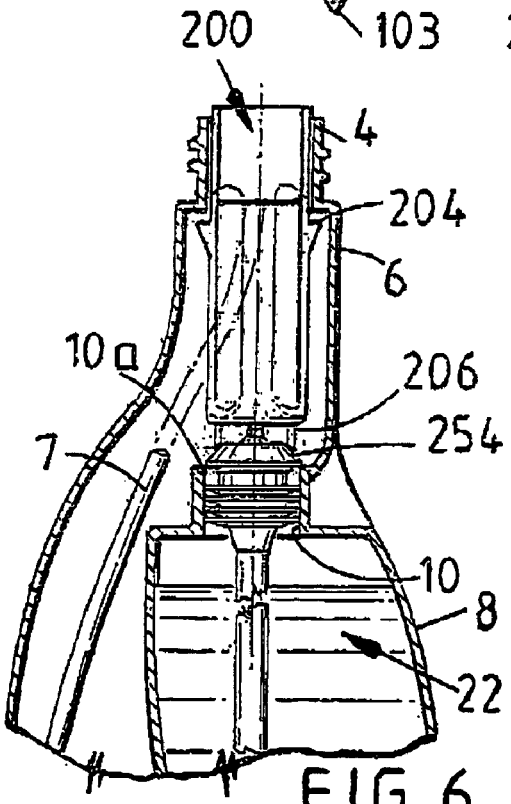
FIG. 6 is a detail of the plugging assembly and bung unit of FIG. 4 in position in a trigger-spray dispensing container.

Reference is now made to FIG. 5 which illustrates a further alternative plugging assembly 200 and associated bung unit 250. The plugging assembly 200 comprises an upper cylindrical head 201 connected to a lower disk 202 by four circumferentially (equally) spaced elongate webs 203 each of which is provided towards its upper end with a tooth 204 having a flat (radially projecting) upper shoulder 204*a* and a downwardly and radially inwardly inclined face 204*b*. The distance between the tips of two diametrically opposed teeth 204 is greater than the width of the month of the bottle but less than that of the neck 6 (see FIG. 6 which incorporates the same reference numerals for the bottle as FIG. 1).

Provided on the underside of the disk 202 is a plug member 205 and a plurality of resilient legs 206, the purpose of which will be described below.

Bung unit 250 comprises a body 251 traversed by a bore (not shown) which is, in effect, an extension of lower tube 253. The body portion 251 has an upper frustoconical head 254 formed in its upper surface with a seat 252 for plug member 205. Below body portion 251 are a plurality of resilient, axially spaced circumferential webs 254.

When the bung unit 250 is located in position in a bottle 2, the circumferential webs 255 locate within the aperture 10 and act as seals. Additionally the underside of the head 254 sits on the edges 10*a* bounding the top of the aperture (see FIG. 6). This ensures that plugging assembly 250 cannot be inserted too far into the bottle 202.

Once the bung position 250 has been located in position as described, the plugging assembly 200 is inserted through the mouth 4 of the bottle. During this insertion, the teeth 204 are pressed radially inwardly (by virtue of their inclined surfaces 204*b* engaging against the rim of the mouth 4 of the bottle). Once the teeth 204 have transversed the length of the mouth 4 of the bottle they are able to move radially outwardly such that withdrawal of the plugging assembly 200 is prevented.

With the plugging assembly 200 inserted in the bottle mouth as described, the lower ends of the legs 206 rest on the frustoconical head 254 of the bung unit and the upper end of plugging assembly 200 projects slightly out of the top of the bottle. The trigger spray unit 3 may now be located in position. This causes the plugging assembly 200 to be moved downwardly so that plug 205 moves onto its seat 252 to close the bore. Additionally the legs 206 splay slightly outwardly as depicted by the dashed lines in FIG. 5.

It will of course be appreciated that the dip tube 7 of the trigger spray unit 3 passes between two of the webs 203.

When the trigger spray unit 3 is removed to fill the bottle 2 then the resilience of legs 206 causes the plugging unit 201 to move upwardly so that the plug 205 is removed from its seat in aperture 252. Thus concentrate 22 may now be transferred from secondary chamber 8 into the main chamber 5, in the manner described more fully above.

The invention claimed is:

1. A multi-use dispensing container for a liquid comprising (i) a single mouth bottle having an upper neck region, a main chamber for holding a first liquid to be dispensed from the container said main chamber being in communication with the neck region, and a secondary chamber for holding a concentrate of the first liquid, and (ii) a closure element removably located on said single mouth of the bottle, wherein the secondary chamber is associated with an outlet aperture through which the concentrate may be transferred via said neck region from the secondary chamber into the main chamber, and wherein the container is provided with a plugging assembly which plugs said outlet aperture when the closure element is located on the mouth of the bottle, allows for transfer of liquid from the secondary chamber into the main chamber when the closure element is removed, and replugs said outlet aperture when the closure element is relocated on the mouth of the baffle.

2. A container as claimed in claim 1 wherein the outlet aperture associated with the secondary chamber is provided directly below said single mouth of the bottle.

3. A container as claimed in claim 2 wherein the outlet aperture associated with the secondary chamber is provided in axial alignment with said single mouth of the bottle.

4. A container as claimed in claim 2 wherein the secondary chamber has a filling aperture located directly below said single mouth of the bottle and said filling aperture is closed by a bung having a bore which provides the outlet aperture of the secondary chamber.

5. A container as claimed in claim 4 wherein a tube extends from the lower end of the bore to the base of the secondary chamber.

6. A container as claimed in claim 5 wherein the base of the secondary chamber slopes towards a well formation and the lower end of the tube locates in this well formation.

7. A container as claimed in claim 1 wherein the dispensing container is such that locating the closure member on the bottle causes the plugging assembly to be moved linearly to push a plug associated therewith onto or into the outlet aperture of the secondary chamber to effect liquid tight closure thereof.

8. A container as claimed in claim 7 wherein the plugging assembly is provided with spring means which urge said assembly away from the aperture when the closure member is removed whereby the plug opens the aperture.

9. A container as claimed in claim 8 wherein said spring means comprise resilient legs provided on the plugging assembly.

10. A container as claimed in claim 1 wherein the secondary chamber has flexible walls such that, with the closure element removed, squeezing of these walls causes liquid to be expressed from the secondary chamber.

11. A container as claimed in claim 1 wherein said single mouth of the bottle is of lesser diameter than the neck region thereof and the plugging assembly comprises an upper head capable of being located in said single mouth of the bottle, a lower plug for closing the outlet aperture of the secondary chamber and an intermediate portion which is of greater cross-sectional size than said single mouth but which is resiliently deformable to reduce its cross-sectional size to permit insertion through said single mouth of the bottle.

12. A container as claimed in claim 1 wherein the plugging assembly has a body which has a greatest cross-sectional size at a position intermediate the head and the plug and which progressively increases in cross-sectional size going in the direction from either the head or the plug to said position.

13. A container as claimed in claim 1 wherein the body portion comprises a plurality of outwardly pointing, generally V-shaped webs.

14. A container as claimed in claim 1 wherein the mouth of the bottle is of lesser diameter than the neck thereof and the plugging assembly comprises an upper head capable of being located in said single mouth of the bottle, a lower plug for closing the outlet aperture of the secondary chamber and an intermediate portion which is resiliently, radially inwardly deformable and which is provided with teeth which may be inserted through said single mouth of the bottle but prevent the plugging assembly being withdrawn therefrom.

15. A container as claimed in claim 12 wherein said intermediate portion comprises axially extending circumferentially spaced webs on which the teeth are provided.

16. A container as claimed in claim 1 wherein the closure member has a dispensing outlet.

17. A container as claimed in claim 1 wherein the closure member is part of a trigger-spray assembly.

18. A container as claimed in claim 15 wherein the closure member comprises a pop-up valve.

* * * * *